US005810179A

United States Patent [19]

Kleiman

[11] Patent Number: 5,810,179

[45] Date of Patent: Sep. 22, 1998

[54] BASKET OR CONTAINER RACK FOR CLOSET SHELVING SYSTEM

[76] Inventor: Ronald Kleiman, 6845 Willowwood Dr., #3084, Boca Raton, Fla. 33434

[21] Appl. No.: 839,855

[22] Filed: Apr. 17, 1997

[51] Int. Cl.[6] ..... A47F 5/00

[52] U.S. Cl. ..... 211/88.01; 211/90.03; 211/85.31; 211/106; 211/126.15; 211/94.02

[58] Field of Search ..... 108/181; 211/88.01, 211/90.01, 90.03, 85.31, 94.02, 126.15, 133.5, 181.1, 186, 187, 133.2, 151, 106

[56] References Cited

U.S. PATENT DOCUMENTS

| | | | |
|---|---|---|---|
| 4,597,616 | 7/1986 | Trubiano | 211/181.1 X |
| 5,086,936 | 2/1992 | Remmers | 211/126.5 |
| 5,205,630 | 4/1993 | Welch et al. | 211/187 X |
| 5,531,464 | 7/1996 | Maurer et al. | 211/126.15 X |
| 5,605,238 | 2/1997 | Jacobs | 211/90.01 |

OTHER PUBLICATIONS

Closet Maid Ventilated Drawer System Product Brochure by Clairson International, Circa 1986.

*Primary Examiner*—Robert W. Gibson, Jr.
*Attorney, Agent, or Firm*—Robert C. Kain, Jr.

[57] ABSTRACT

The rack for a basket or container is, in one embodiment, utilized in combination with a closet shelving system. This system includes at least two vertical, spaced apart stationary poles. The basket or container includes opposing lips extending from opposite sides of the basket or container. The rack includes a pair of C-shaped elongated channels, an inverted U-shaped cross-member and, in one embodiment, a rearward cross-member. Each C-shaped channel is attached to the rearward cross-member at the channel's rearward terminal end. At the forward terminal end, the C-shaped channel is attached to depending legs of the inverted U-shaped cross-member. The U-shaped cross-member has a bridge member spanning the distance between the two vertical, spaced apart poles. The depending legs of the U-shaped cross-member are removably mounted to the vertical poles. The rearward cross-member is mounted to the wall via an appropriate mounting system. The basket or container slides in the C-shaped channels because the channel mouths of each C-shaped channel face each other. In another embodiment, a pair of wall mount brackets captures the terminal rearward ends of the C-shaped channels thereby eliminating the rearward cross-member. In further embodiment, the rack is mounted independently of the closet shelving system and utilizes a pair of angled wall bracket supports. The rearward ends of the angled wall bracket supports are mounted on the wall and the forward ends of the angled supports are coupled to either the depending legs of the inverted U-shaped cross-member or are coupled to the C-shaped elongated channels.

20 Claims, 4 Drawing Sheets

BASKET OR CONTAINER RACK FOR CLOSET SHELVING SYSTEM

The present invention relates to a rack for a basket or a container which may utilized in combination with a closet shelving system or which may be used independently.

BACKGROUND OF THE INVENTION

Closet shelving systems enable users to more efficiently utilize space in a closet or other storage area. These shelving systems normally include at least a pair, and sometimes more, vertical poles which are spaced apart from each other and which are spaced away from a vertical wall. Known closet systems also utilize plastic-coated wire shelves and plastic-coated wire hanger bars which divide up the storage area into shelf space and space to hang articles of clothing. The articles of clothing are placed on hangers and the hangers are hung on the hanger bars. Of course, rather than use plastic-coated wire, the shelving systems may be made entirely out of rigid sturdy plastic. Also, these shelving systems may utilize treated metal rather than plastic-coated metal wire.

A closet system sold under the trademark CLOSET MAID by Clairson International of Ocala, Fla., includes a frame set which retains slidable containers or baskets therein. These frame sets include four upright vertical poles having, along one side, a plurality of side bars into which slide laterally extending lips of the basket or container. The four poles either sit on the floor or are fixed to a rolling frame moveable over the floor. The front or forward pair of vertical uprights are attached to stationary upper and lower cross-members. The rearward pair of uprights are attached to upper and lower cross-members. However, the CLOSET MAID frame set and drawer system is sold as a singular, integral unit and users cannot position or mount the slidable containers or baskets at any location in the closet system other than in the 17", 29" and 41" high solid rectangular structure defined by the forward pair of uprights, the corresponding upper and lower cross-members, the rearward pair of uprights and the rearward upper and lower cross-members. These frame sets either rest directly on the floor or roll over the floor via casters.

OBJECTS OF THE INVENTION

It is an object of the present invention to provide a rack for a basket or container which is utilized in combination with a closet shelving system.

It is another object of the present invention to provide a rack for a basket or a container which can be mounted independently on a vertical wall.

It is another object of the present invention to provide a rack which can be installed anywhere on a pair of vertically spaced apart stationary poles in a closet shelving system.

It is an additional object of the present invention to provide a basket or container rack which increases the utilization of closet or storage space and enables the user to more efficiently place or locate the drawer, basket or container in the closet shelving system.

It is a further object of the present invention to provide a rack for a basket or container which is not limited to installation on a floor and which can be utilized as a single rack or frame in the closet system for the basket or container.

It is another object of the present invention to provide a rack for a basket or container which is easily installed.

It is a further object of the present invention to provide a rack which can accommodate baskets or containers having different vertical dimensions or heights.

It is another object of the present invention to provide a rack which enables the user to place multiple racks on the two vertically spaced apart poles to accommodate multiple baskets or containers.

It is another object of the present invention to provide a rack which enables the user to utilize storage space beneath the slidable basket or container.

It is an additional object of the present invention to provide a rack which limits or eliminates lateral movement of the vertical poles in the closet shelving system.

SUMMARY OF THE INVENTION

The rack for a basket or container is, in one embodiment, utilized in combination with a closet shelving system. This system includes at least two vertical, spaced apart stationary poles. The basket or container includes opposing lips extending from opposite sides of the basket or container. The rack includes a pair of C-shaped elongated channels, an inverted U-shaped cross-member and, in one embodiment, a rearward cross-member. Each C-shaped channel is attached to the rearward cross-member at the channel's rearward terminal end. At the forward terminal end, the C-shaped channel is attached to depending legs of the inverted U-shaped cross-member. The U-shaped cross-member has a bridge member spanning the distance between the two vertical, spaced apart poles. The depending legs of the U-shaped cross-member are removably mounted to the vertical poles. The rearward cross-member is mounted to the wall via an appropriate mounting system. The basket or container slides in the C-shaped channels because the channel mouths of each C-shaped channel face each other. In another embodiment, a pair of wall mount brackets captures the terminal rearward ends of the C-shaped channels thereby eliminating the rearward cross-member. In a further embodiment, the rack is mounted independently of the closet shelving system and utilizes a pair of angled wall bracket supports. The rearward ends of the angled wall bracket supports are mounted on the wall and the forward ends of the angled supports are coupled to either the depending legs of the inverted U-shaped cross-member or are coupled to the C-shaped elongated channels.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a rack for a basket or container which may be used in combination with a closet shelving system or which may be used independently thereof if the rack includes a pair of angled wall bracket supports.

Figure 1:
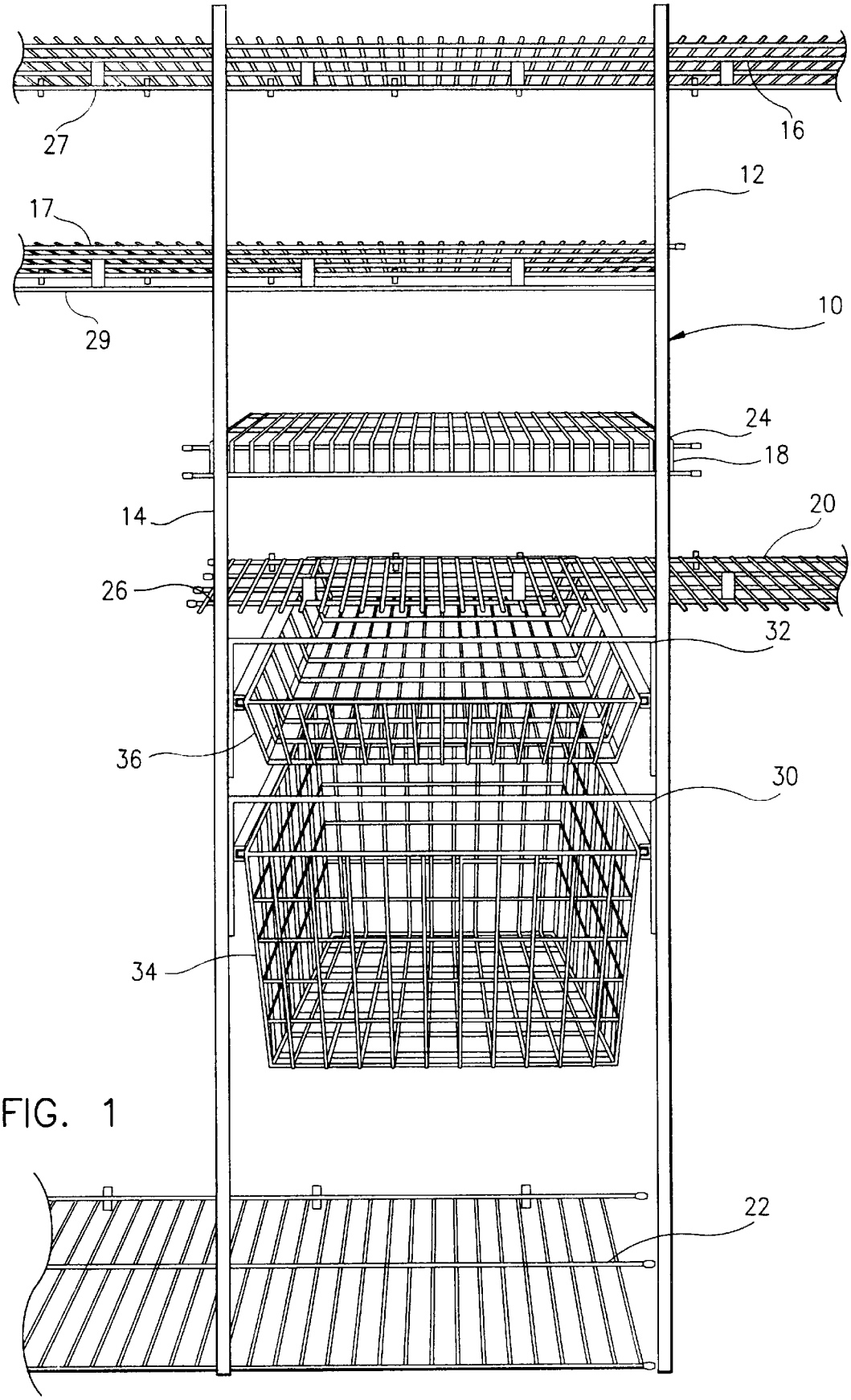
FIG. 1 diagrammatically illustrates two racks, each holding a respective slidable basket, mounted in a closet shelving system in accordance with the principles of the present invention.

FIG. 1 diagrammatically illustrates closet system 10 which includes a pair of vertical spaced apart stationary poles 12, 14. The closet shelving system, in the illustrated embodiment, includes a plurality of wire shelves 16, 17, 18, 20 and 22. These plastic coated wire shelves are attached to vertical poles 12, 14 by couplers at intersecting locations. For example, with respect to shelf 18, the pole couplers are found at points 24 and 26. Shelves 16 and 17 include hanger bars 27, 29 which enable the user to hang clothes thereon.

The rack systems 30, 32, in accordance with the principles of the present invention, are mounted to vertical poles 12, 14. As shown in the illustrated embodiment, rack systems 30, 32 slidably retain baskets 34, 36. Although baskets 34, 36 are shown herein, containers could be utilized having the same length (depth to the wall) and width (lateral extent) as the baskets. Baskets or containers having different heights may be utilized on rack system 32.

Figure 2:
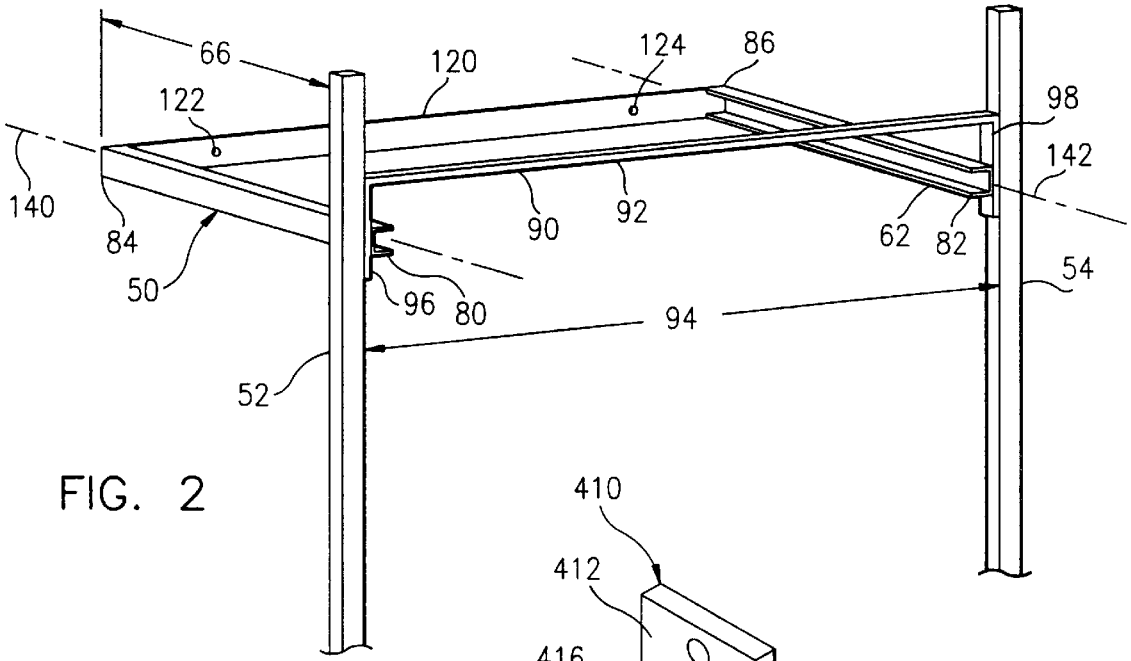
FIG. 2 diagrammatically illustrates a perspective view of the rack attached to a wall and attached to two vertical, spaced apart stationary poles in accordance with the principles of the present invention.

FIG. 2 diagrammatically illustrates a detailed view of rack system 50. Rack system 50 is attached to vertical poles 52, 54 as described hereinafter.

Figure 3:
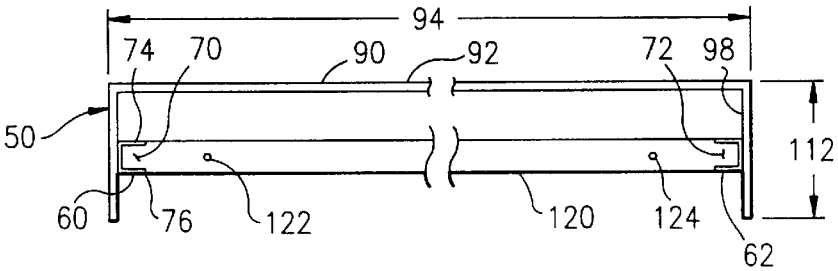
FIG. 3 diagrammatically illustrates a front elevational view of the rack in accordance with the principles of the present invention.
Figure 4:
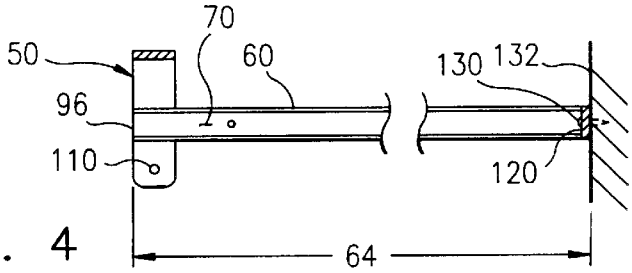
FIG. 4 diagrammatically illustrates a partial, side view of the rack.

FIG. 3 diagrammatically illustrates a front elevational view of rack system 50 and FIG. 4 diagrammatically illustrates a partial, side view of rack system 50. FIGS. 2, 3 and 4 will be discussed concurrently herein.

In one embodiment, the rack system includes a pair of C-shaped elongated channels 60, 62 each having a length 64 substantially equivalent to distance 66 which is the predetermined distance between the wall and the vertical, spaced apart stationary poles 52, 54. In other words, the channels span the distance between poles 52, 54 and the wall. Each C-shaped channel includes a channel mouth 70, 72 that is defined by upper and lower ledges or lips. With respect to channel 60, lips 74, 76 define channel mouth 70. Channel mouths 70, 72 face each other and define a planar slide plane within which slides the laterally extending lips from the basket or container. This is described later in connection with FIGS. 5 and 6. Channels 60, 62 include forward terminal ends 80, 82 and rearward terminal ends 84, 86. The forward terminal ends 80, 82 are connected or mounted to an inverted U-shaped cross-member 90. U-shaped cross-member 90 includes a bridge member 92 having a length 94 substantially equivalent to the lateral distance 96 between stationary vertical poles 52, 54.

The U-shaped cross-member 90 also includes first and second depending legs 96, 98. Front terminal ends 80, 82 of channels 60, 62 are attached or mounted to depending legs 96, 98. In the illustrated embodiment, the mounting occurs at an intermediate position on legs 96, 98. This mounting, in a preferred embodiment, is a weld mount. Other methods and systems could be utilized to attach channels 60, 62 to depending legs 96, 98. These include glue, nuts and bolts and other types of attachment mechanisms. Preferably, a weld is utilized.

U-shaped cross-member 90 limits the lateral movement of vertical poles 52, 54. In the closet system illustrated in FIG. 1, vertical poles 12, 14 can move laterally approximately 1" due to the coupling mechanism on shelves 16, 17, 24, 20 and 22. When the rack system 50 is utilized with this type of closet shelving system, rack system 50 (and rack systems 30, 32 in FIG. 1), securely mount to vertical poles 52, 54 (and poles 12, 14 in FIG. 1) thereby limiting lateral movement of the poles. This feature of the present invention enhances the stability of the closet shelving system. Depending legs 96, 98 are mounted to vertical poles 52, 54 by self tapping screws fed through holes, such as hole 110 on leg 96 in FIG. 4 and other holes in vertical poles 52, 54. Otherwise, a nut and bolt mounting system or screws, which are threadable in prepunched holes in the components can be utilized. Stability of vertical poles 52, 54 is also enhanced by the size or length 112 of the depending leg. For example, in FIG. 3, length 112 is identified in conjunction with depending leg 98. Of course, more than one hole and mount could be utilized on each depending leg in order to securely mount inverted U-shaped cross-member 90 onto vertical poles 52, 54.

Rack system 50 also includes, in the embodiments illustrated in FIGS. 2–4, a rearward cross-member 120. Rearward cross-member 120 has a length substantially equivalent to inverted U-shape cross-member 90 and also substantially equivalent to distance 96 which is the distance between vertically spaced apart stationary poles 52, 54. Rearward cross-member 120 includes at least two, and possibly more, holes 122, 124 through which is inserted screws or bolts which attach member 120 to the vertical wall. See screw or bolt 130 which attaches rearward cross-member 120 to wall 132 in FIG. 4. Typically, screws are utilized which fit into anchors mounted in wall 132.

When rearward cross-member 120 is mounted on the wall, C-shaped channels 60, 62 form a planar slide plane identified in FIG. 2 by lines 140, 142. Since the channel mouths 70, 72 of C-shaped channels 60, 62 face each other, the opposing, laterally extending lips of the basket or container are adapted to be captured in channels 60, 62 such that the basket or container moves within the slide plane 140, 142.

Figure 5:
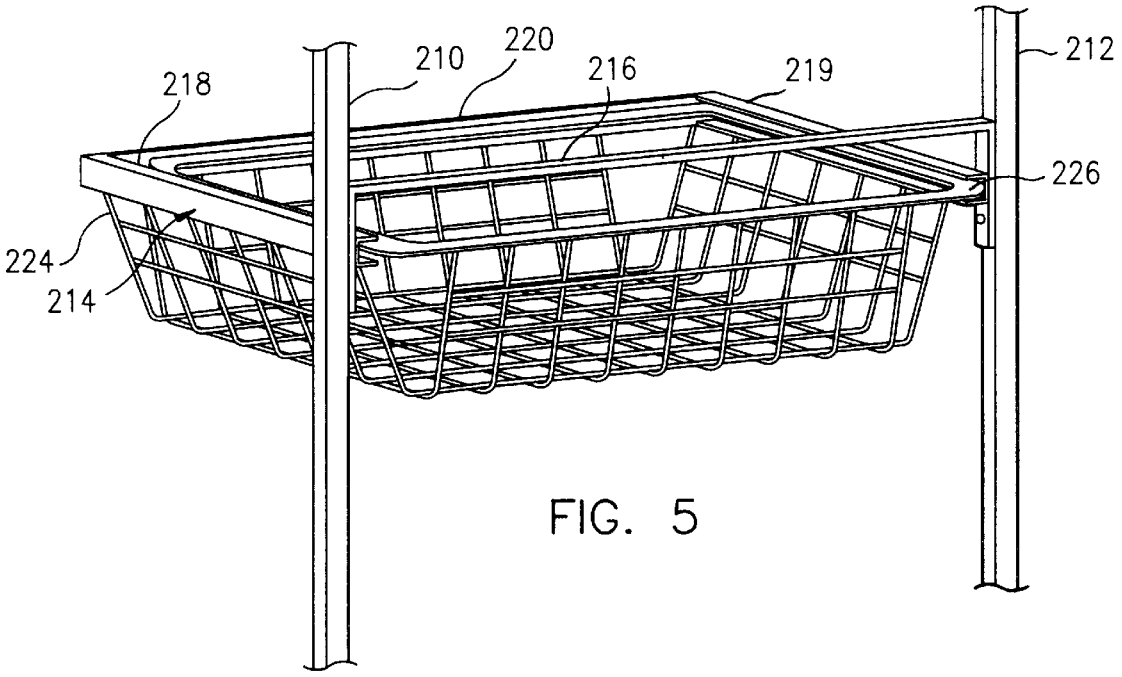
FIG. 5 diagrammatically illustrates the rack holding a single basket.

In FIG. 5, rack system 214 is removably mounted to vertical poles 210, 212. Rack system 214 includes U-shaped forward cross-member 216, channels 218, 219 and rearward cross-member 220. A basket 224 has laterally extending lips, one of which is lateral extending lip 226, extending from opposing sides of the structure. The laterally extending lips are captured by the channels 218, 219. Basket 224 slides or moves in the slide plane such that the basket can be withdrawn entirely from the channel defined slide plane.

Figure 6:
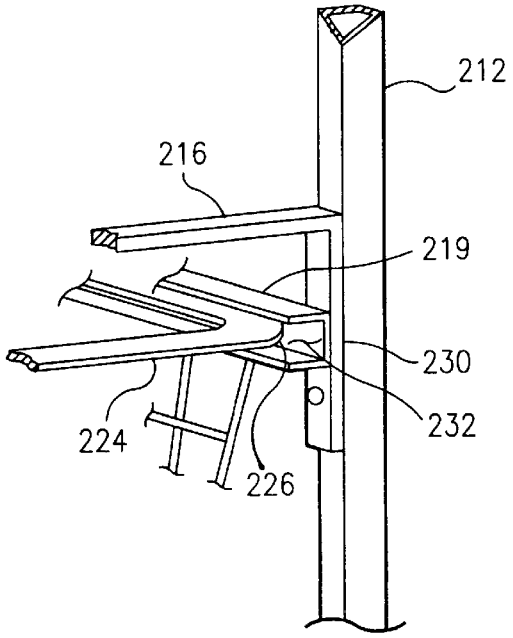
FIG. 6 diagrammatically illustrates a detailed view of a portion of the rack with the slidable basket or container therein.

FIG. 6 shows a detailed view of one corner of the rack system. Vertical pole 121 is removably mounted to leg 230 of inverted U-shaped cross-member 216. Channel 219 has a channel mouth 232 within which is captured laterally extending lip 226 of basket 224.

Figure 7:
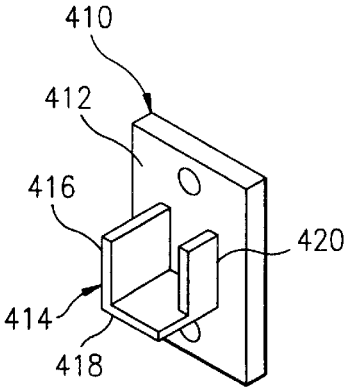
FIG. 7 diagrammatically illustrates a wall mount bracket which eliminates the rearward cross-member.

Rack system 50 in FIG. 2 can be changed to eliminate rearward cross-member 120. By eliminating rearward cross-member 120, the rack system requires some type of wall mount. One type of wall mount includes a pair of wall mount brackets, one of which is shown as bracket 410 in FIG. 7.

Bracket 410 includes a wall plate 412 and a retainer 414. Retainer 414 includes a vertical wall 416, a horizontal wall or plate 418 and a second vertical wall 420. Second vertical wall 420 is spaced apart from first vertical wall 416 in order to capture terminal end 84 of C-shaped channel 60 therebetween. Of course, a second wall mount bracket is utilized to capture terminal end 86 of C-shaped channel 62. The wall mount bracket for terminal end 86 is a mirror image of bracket 410. In other words, second or locking wall 420 is disposed on the left side of retainer 414 and the first wall 416 would be on the right side. Locking wall 420 prohibits lateral movement of terminal end 84 when disposed in the locking space defined by walls 416, 420 and floor plate 418. It is important that C-shaped channels 60, 62 are mounted in a horizontal plane which establishes the slide plane for the basket or container. Other types of retainers, other than the retainer structure shown as retainer 414 in FIG. 7 can be utilized for the wall mount brackets.

Figure 8:
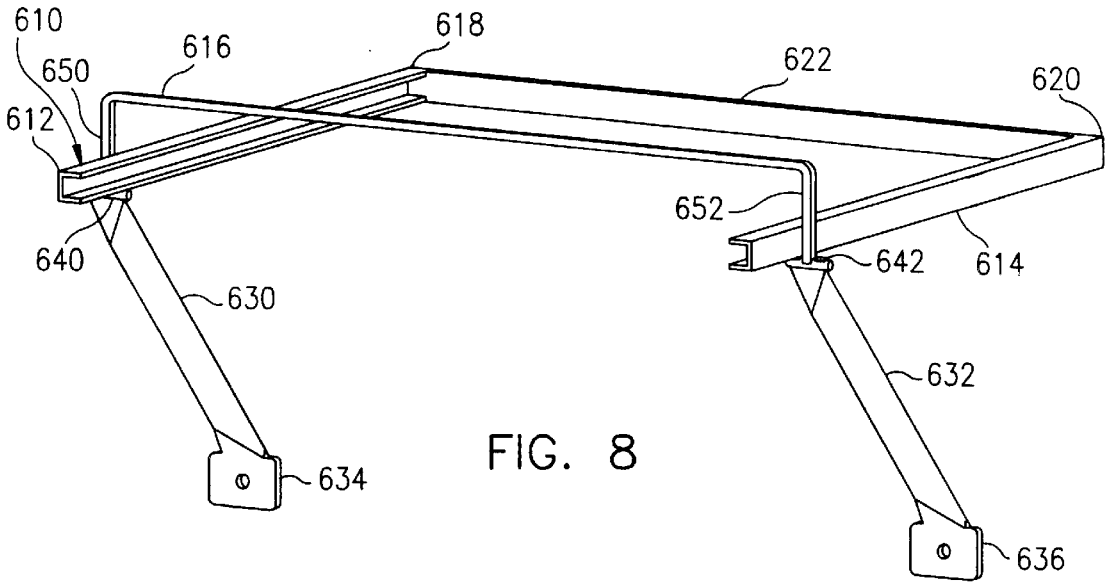
FIG. 8 diagrammatically illustrates the rack with a pair of angled wall bracket supports such that the rack is independently mounted on the wall.
Figure 9:
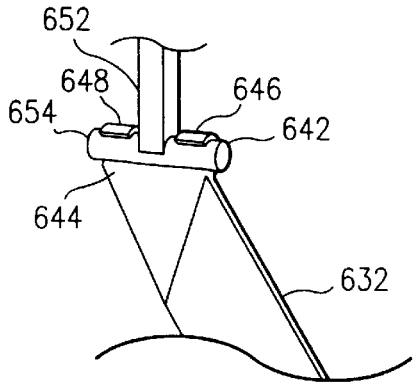
FIG. 9 diagrammatically illustrates one type of coupling to attach the rack to the angled wall bracket supports.
Figure 10:
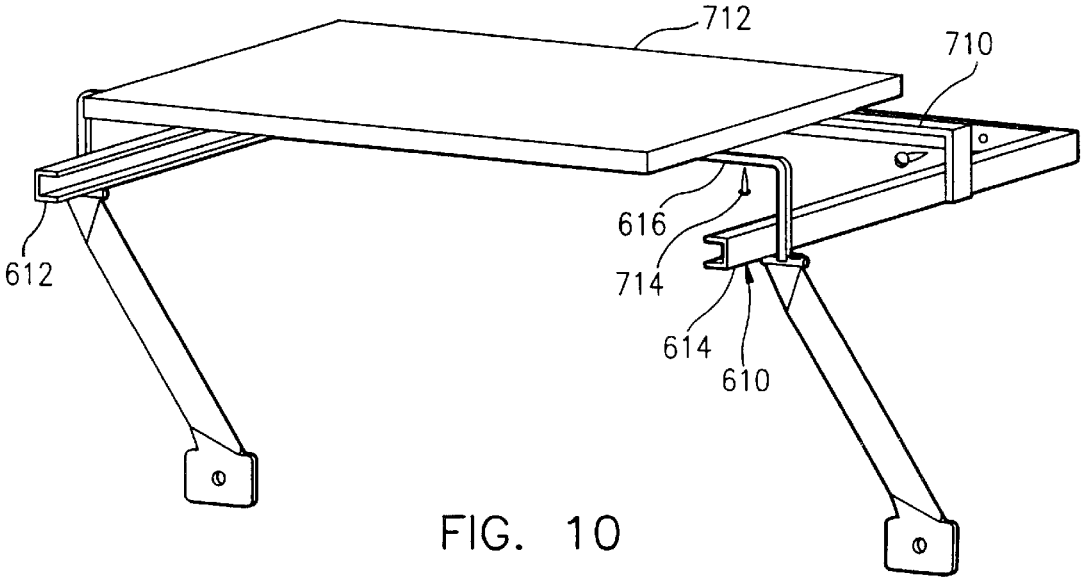
FIG. 10 diagrammatically illustrates the rack with a top shelf plate attached thereto.

FIGS. 8, 9 and 10 diagrammatically illustrate rack system 610 which is mounted on a vertical wall independent of closet shelving system 10 shown in FIG. 1. FIGS. 8, 9 and 10 are described concurrently herein. Rack system 610 includes C-shaped channels 612, 614 that are substantially similar to the C-shaped channels described earlier. Inverted U-shaped cross-member 616 is mounted or attached preferably at an intermediate portion approximately two-thirds away from terminal rear ends 618, 620 of C-shaped channels 612, 614. Rack system 610 also includes a rearward cross-member 622. Rearward cross-member 622 is mounted to the wall. The independently mounted rack system 610 includes a pair of angled wall bracket supports 630, 632. Wall bracket supports 630, 632 include rearward terminal ends 634, 636 which are mounted to the wall. For example, a mounting system similar to that described above in conjunction with FIG. 4 may be utilized. Angled wall bracket supports 630, 632 also include couplers 640, 642. FIG. 9 shows one type of coupler 642 used in conjunction with angled bracket 632.

Inverted U-shaped cross-member 616 includes depending legs 650, 652. Depending leg 652 includes an attached horizontally disposed, solid cylindrical section 654. Terminal end 642 of angled bracket 632 includes a generally semi-cylindrical surface defined by lower arcuate surface 644 and upper arcuate tabs 646, 648. Lower arcuate surface 644 and tabs 646, 648 snap into or lock onto cylindrical element 654 with an interference fit. As described earlier, cylindrical element 654 is attached by welding or other means to depending leg 652. Other types of couplers to secure terminal end 642 to depending leg 652 may be utilized. Also, terminal end 642 of angled wall bracket 632 (as well as the terminal end 640 of angled wall bracket 630) may cooperate with a coupler system mounted on channel 614. In other words, cylindrical member 654 could be attached at an appropriate position on channel 614 away from depending leg 652. Other coupling mechanisms such as nuts and bolts and self-threading screws may be utilized to connect terminal ends 640, 642 of angled wall brackets 630, 632 to either channels 612, 614 or depending legs 650, 652 of inverted U-shaped cross-member 616.

FIG. 10 shows rack system 610 including a supplemental inverted U-shaped cross-member 710. A plate or shelf 712 is placed on top of cross-members 616, 610 and is secured thereto by screws or bolts, one of which is screw 714. In this manner, a basket is inserted into the slide plane defined by channels 612, 614 while the user may place other articles on top of plate 712.

It should be noted that the self standing or independent rack system 610 may utilize a pair of wall mount brackets discussed above in connection with FIG. 7. The wall mount brackets eliminate the rearward cross-member.

The rack system utilizes rounded corners in order to eliminate injuries due to sharp edges.

The claims appended hereto are meant to cover modifications and changes within the scope and spirit of the present invention.

What is claimed is:

1. A rack for a basket or container, in combination with a closet shelving system, the closet shelving system having at least two vertical, spaced apart, stationary poles permanently mounted a first predetermined distance apart and a second predetermined distance away from a wall, said basket or container having opposing lips extending from opposite sides of said basket or container, said lips defining an open, planar top region of said basket or container, the rack comprising:

a pair of C-shaped, elongated channels, each channel having a forward end and a rearward end and a channel mouth, each said channel having a length substantially equivalent to said second predetermined distance;

an inverted U-shaped cross-member having bridge member, spanning said first predetermined distance between said spaced apart vertical poles, and first and second depending legs which form, in conjunction with said bridge member, said U-shaped cross-member, a respective one of said forward ends of said C-shaped channels mounted onto a corresponding one of said first and second depending legs such that said channel mouths face each other;

means for mounting a respective one of said depending first and second legs onto a corresponding one of said vertical spaced apart poles;

a rearward cross-member having a length substantially equivalent to said first predetermined distance, said rearward cross-member having a first and a second end respectively mounted onto a corresponding rearward end of a respective one of said channels; and, means for mounting said rearward cross-member onto said wall at a position which establishes a planar slide plane defined by said opposing channels, said opposing lips of said basket or container adapted to be captured in said opposing channels such that said basket or container moves within said slide plane.

2. A rack as claimed in claim 1 wherein said opposing lips of said basket or container extend outward from a respective side in a horizontal plane and wherein said slide plane is a horizontal slide plane.

3. A rack as claimed in claim 1 wherein said U-shaped cross-member is a first U-shaped cross-member, and the rack includes a second U-shaped cross-member having supplemental bridge member and supplemental first and second depending legs, a respective one of said supplemental first and second depending legs mounted at an intermediate position onto a corresponding one of said an said C-shaped channels.

4. A rack as claimed in claim 3 wherein said rack further includes a plate mountable onto said first and second inverted U-shaped cross-members above said slide plane.

5. A rack for a basket or container, in combination with a closet shelving system, the closet shelving system having at least two vertical, spaced apart, stationary poles permanently mounted a first predetermined distance apart and a second predetermined distance away from a wall, said basket or container having opposing lips extending from opposite sides of said basket or container, said lips defining an open, planar top region of said basket or container, the rack comprising:

a pair of C-shaped, elongated channels, each channel having a forward end and a rearward end and a channel mouth, each said channel having a length substantially equivalent to said second predetermined distance;

an inverted U-shaped cross-member having bridge member, spanning said first predetermined distance between said spaced apart vertical poles, and first and second depending legs which form, in conjunction with said bridge member, said U-shaped cross-member, a respective one of said forward ends of said C-shaped channels mounted onto a corresponding one of said first and second depending legs such that said channel mouths face each other;

means for mounting a respective one of said depending first and second legs onto a corresponding one of said vertical spaced apart poles;

a pair of wall mount brackets, each bracket forming a retainer to capture a respective one of said rearward ends of said channels; and, means for mounting said wall mount brackets onto said wall at a position which establishes a planar slide plane defined by said opposing channels when said respective ends thereof are disposed in said corresponding retainers, said opposing lips of said basket or container adapted to be captured in said opposing channels such that said basket or container moves within said slide plane.

6. A rack as claimed in claim 5 wherein said opposing lips of said basket or container extend outward from a respective side in a horizontal plane and wherein said slide plane is a horizontal slide plane.

7. A rack as claimed in claim 5 wherein said U-shaped cross-member is a first U-shaped cross-member, and the rack includes a second U-shaped cross-member having supplemental bridge member and supplemental first and second depending legs, a respective one of said supplemental first and second depending legs mounted at an intermediate position onto a corresponding one of said an said C-shaped channels.

8. A rack as claimed in claim 7 wherein said rack further includes a plate mountable onto said first and second inverted U-shaped cross-members above said slide plane.

9. A rack for mounting a basket or container on a wall, said basket or container having opposing lips extending from opposite sides thereof, said lips defining an open, rectangular, planar top region of said basket or container, said lips having a length and a width defined by first and second predetermined distances, the rack comprising:

a pair of C-shaped, elongated channels, each channel having a forward end and a rearward end and a channel mouth;

an inverted U-shaped cross-member having bridge member, spanning said first predetermined distance, and first and second depending legs which form, in conjunction with said bridge member, said U-shaped cross-member;

a pair of angled wall bracket supports, each angled wall bracket support having a rearward end, mountable onto said wall, and a forward end;

a pair of couplers, a respective coupler attached between a corresponding forward end of a respective angled wall bracket support and a corresponding one of said first and second depending legs of said U-shaped cross-member;

means for mounting a respective one of said depending first and second legs onto a corresponding one of said channels;

a rearward cross-member having a length substantially equivalent to said first predetermined distance, said rearward cross-member having a first and a second end respectively mounted onto a corresponding rearward end of a respective one of said channels; and, means for mounting said rearward cross-member onto said wall at a position which establishes a planar slide plane defined by said opposing channels, said opposing lips of said basket or container adapted to be captured in said opposing channels such that said basket or container moves within said slide plane.

10. A rack as claimed in claim 9 wherein said U-shaped cross-member is a first U-shaped cross-member, and the rack includes a second U-shaped cross-member having supplemental bridge member and supplemental first and second depending legs, a respective one of said supplemental first and second depending legs mounted at an intermediate position onto a corresponding one of said an said C-shaped channels.

11. A rack as claimed in claim 10 wherein said rack further includes a plate mountable onto said first and second inverted U-shaped cross-members above said slide plane.

12. A rack for mounting a basket or container on a wall, said basket or container having opposing lips extending from opposite sides thereof, said lips defining an open, rectangular, planar top region of said basket or container, said lips having a length and a width defined by first and second predetermined distances, the rack comprising:

a pair of C-shaped, elongated channels, each channel having a forward end and a rearward end and a channel mouth;

an inverted U-shaped cross-member having bridge member, spanning said first predetermined distance, and first and second depending legs which form, in conjunction with said bridge member, said U-shaped cross-member;

a pair of angled wall bracket supports, each angled bracket support having a rearward end, mountable onto said wall, and a forward end;

a pair of couplers, a respective coupler attached between a corresponding forward end of a respective angled wall bracket support and a corresponding one of said pair of C-shaped channels;

means for mounting a respective one of said depending first and second legs onto a corresponding one of said channels;

a rearward cross-member having a length substantially equivalent to said first predetermined distance, said rearward cross-member having a first and a second end respectively mounted onto a corresponding rearward end of a respective one of said channels; and, means for mounting said rearward cross-member onto said wall at a position which establishes a planar slide plane defined by said opposing channels, said opposing lips of said basket or container adapted to be captured in said opposing channels such that said basket or container moves within said slide plane.

13. A rack as claimed in claim 12 wherein said U-shaped cross-member is a first U-shaped cross-member, and the rack includes a second U-shaped cross-member having supplemental bridge member and supplemental first and second depending legs, a respective one of said supplemental first and second depending legs mounted at an intermediate position onto a corresponding one of said an said C-shaped channels.

14. A rack as claimed in claim 13 wherein said rack further includes a plate mountable onto said first and second inverted U-shaped cross-members above said slide plane.

15. A rack for mounting a basket or container on a wall, said basket or container having opposing lips extending from opposite sides thereof, said lips defining an open, rectangular, planar top region of said basket or container, said lips having a length and a width defined by first and second predetermined distances, the rack comprising:

a pair of C-shaped, elongated channels, each channel having a forward end and a rearward end and a channel mouth;

an inverted U-shaped cross-member having bridge member, spanning said first predetermined distance, and first and second depending legs which form, in conjunction with said bridge member, said U-shaped cross-member;

a pair of angled wall bracket supports, each angled wall bracket support having a rearward end, mountable onto said wall, and a forward end;

a pair of couplers, a respective coupler attached between a corresponding forward end of a respective angled wall bracket support and a corresponding one of said first and second depending legs of said U-shaped cross-member;

means for mounting a respective one of said depending first and second legs onto a corresponding one of said channels;

a pair of wall mount brackets, each wall mount bracket forming a retainer to capture a respective one of said rearward ends of said channels; and, means for mounting said wall mount brackets onto said wall at a position which establishes a planar slide plane defined by said opposing channels when said respective ends thereof are disposed in said corresponding retainers, said opposing lips of said basket or container adapted to be captured in said opposing channels such that said basket or container moves within said slide plane.

16. A rack as claimed in claim 15 wherein said U-shaped cross-member, and the rack includes a second U-shaped cross-member having supplemental bridge member and supplemental first and second depending legs, a respective one of said supplemental first and second depending legs mounted at an intermediate position onto a corresponding one of said an said C-shaped channels.

17. A rack as claimed in claim 16 wherein said rack further includes a plate mountable onto said first and second inverted U-shaped cross-members above said slide plane.

18. A rack for mounting a basket or container on a wall, said basket or container having opposing lips extending from opposite sides thereof, said lips defining an open, rectangular, planar top region of said basket or container, said lips having a length and a width defined by first and second predetermined distances, the rack comprising:

a pair of C-shaped, elongated channels, each channel having a forward end and a rearward end and a channel mouth;

an inverted U-shaped cross-member having bridge member, spanning said first predetermined distance, and first and second depending legs which form, in conjunction with said bridge member, said U-shaped cross-member;

a pair of angled wall bracket supports, each angled bracket support having a rearward end, mountable onto said wall, and a forward end;

a pair of couplers, a respective coupler attached between a corresponding forward end of a respective angled wall bracket support and a corresponding one of said pair of C-shaped channels;

means for mounting a respective one of said depending first and second legs onto a corresponding one of said channels;

a pair of wall mount brackets, each wall mount bracket forming a retainer to capture a respective one of said rearward ends of said channels; and, means for mounting said wall mount brackets onto said wall at a position which establishes a planar slide plane defined by said opposing channels when said respective ends thereof are disposed in said corresponding retainers, said opposing lips of said basket or container adapted to be captured in said opposing channels such that said basket or container moves within said slide plane.

19. A rack as claimed in claim 18 wherein said U-shaped cross-member is a first U-shaped cross-member, and the rack includes a second U-shaped cross-member having supplemental bridge member and supplemental first and second depending legs, a respective one of said supplemental first and second depending legs mounted at an intermediate position onto a corresponding one of said an said C-shaped channels.

20. A rack as claimed in claim 19 wherein said rack further includes a plate mountable onto said first and second inverted U-shaped cross-members above said slide plane.

* * * * *